US006685049B1

(12) United States Patent
Paladino

(10) Patent No.: US 6,685,049 B1
(45) Date of Patent: Feb. 3, 2004

(54) THIN WALL CLOSURE FOR USE WITH A CONTAINER

(75) Inventor: Jason Joseph Paladino, Orland Park, IL (US)

(73) Assignee: Landis Plastics, Inc., Chicago Ridge, IL (US)

( * ) Notice: Subject to any disclaimer, the term of this patent is extended or adjusted under 35 U.S.C. 154(b) by 0 days.

(21) Appl. No.: 09/571,634

(22) Filed: May 15, 2000

Related U.S. Application Data

(60) Provisional application No. 60/166,571, filed on Nov. 19, 1999.

(51) Int. Cl.[7] ..... B65D 41/18

(52) U.S. Cl. ..... 220/781; 220/380; 220/780; 206/515

(58) Field of Search ..... 206/503, 508, 206/511, 515, 519, 505; 220/380, 780, 781

(56) References Cited

U.S. PATENT DOCUMENTS 1,077,235 A * 10/1913 Wagandt
3,137,409 A * 6/1964 Davis
3,339,786 A * 9/1967 Biglin
3,353,708 A * 11/1967 Davis
3,424,342 A * 1/1969 Scopp et al. ..... 220/780 X
3,642,167 A * 2/1972 Kinney
3,664,544 A * 5/1972 Hammes ..... 220/780 X
3,722,731 A * 3/1973 McCormick et al.
3,724,710 A * 4/1973 Davis
3,931,890 A * 1/1976 Davis
4,014,459 A * 3/1977 Robinson ..... 206/580 X
4,138,034 A * 2/1979 McCarthy
4,166,548 A * 9/1979 Crisci ..... 220/780 X
4,194,645 A * 3/1980 Zabner et al. ..... 220/380 X
4,341,324 A * 7/1982 Ramirez
4,364,476 A * 12/1982 Weller et al. ..... 206/508
4,407,426 A * 10/1983 McLaren et al. ..... 206/508 X
4,632,265 A * 12/1986 Cochrane
4,811,860 A * 3/1989 Sorenson et al. ..... 220/380
4,817,801 A * 4/1989 Schwaikert ..... 206/508 X
4,844,263 A * 7/1989 Hadtke ..... 206/508
4,854,472 A * 8/1989 Semersky ..... 220/780
4,856,674 A * 8/1989 Berney ..... 220/380 X
4,872,304 A * 10/1989 Thompson
4,886,184 A * 12/1989 Chamourian ..... 206/508 X
5,046,632 A * 9/1991 Bordner
5,385,255 A * 1/1995 Varano et al.
5,904,266 A * 5/1999 Tedeschi, Jr. ..... 220/781 X
5,960,985 A * 10/1999 Barrett ..... 206/508 X

* cited by examiner

*Primary Examiner*—Robin Hylton
(74) *Attorney, Agent, or Firm*—Fitch, Even, Tabin & Flannery

(57) ABSTRACT

An injection molded closure is provided for containers that can hold cold products or the like, such as dairy products. The closure is made with a thin wall construction of 0.020 inch or less to provide a lightweight, inexpensive closure. The preferred closure is made of polypropylene with flared skirt walls that are not toed-in. The closures are supported in the stack by radially inner and outer stacking surfaces. The skirt walls are spaced slightly apart, when the closures are stacked, for example, with a 0.002 inch air gap between the skirt walls when perfectly centered with the skirt walls aiding in self-centering of the closures within the stack. An air vent may be provided to allow escape of air between nested, adjacent closures.

7 Claims, 9 Drawing Sheets

THIN WALL CLOSURE FOR USE WITH A CONTAINER

This application claims the benefit of Provisional Application No. 60/166,571, filed Nov. 19, 1999.

FIELD OF THE INVENTION

The present invention relates to injection-molded closures, and more particularly to a thin walled, injection-molded closure and container usable with various contents including frozen contents in a container.

BACKGROUND OF THE INVENTION

Many products, including frozen or refrigerated product, are stored in plastic containers having a complementary plastic lid or closure which engages and seals the container and the contents therein. Some of the very cold products are subjected to a −40° F. blast freezing process and then are subjected to a drop in temperature and often are kept at 0° F. in the frozen foods departments of a grocery store or the like. These cold temperatures make the plastic of the closures and containers more brittle and more likely to fail under tests to which the closed containers are subjected, such as drop tests, while the containers are cold and full of the contents. For cold closures being drop tested, the stress is concentrated at sharp corners on the closure, which tends to fail there. Typically, conventional closures or lids are made from polyethylene such as low density polyethylene, linear flow density polyethylene and high density polyethylene plastic. For injection-molded polyethylene closures, the lower limit for the wall thickness is usually above 0.024 inch thick. While the closures made of these materials having thick walls of 0.020 inch and greater performed adequately, for some applications there is a desire to reduce that thickness of the wall and to make the container less costly because of having less plastic therein.

Conflicting with the desire to reduce the wall thickness when using one of the polyethylene plastics in an injection mold closure, is a desire to have a central panel of the closure be flat and planer for printing or staying out of contact with the container contents. That is, when the polyethylene closure panel is molded to be less than 0.020 inch thick, there is a problem maintaining the central panel in a flat horizontal plane for printing or for aesthetic reasons. Although polypropylene plastic as well as polyethylene has been used in the manufacture of injection-molded lids, polypropylene is not generally used in cold applications because the polypropylene plastic has a generally more brittle characteristic at cold temperatures than the polyethylene plastic.

Linear flow polyethylene is commonly used to injection mold closures because it flows adequately within narrow lid cross sections in the mold and has good strength characteristics particularly for low temperature applications of frozen foods or the like. Polypropylene actually has a better melt index in that it flows better in thin cross-section parts than does polyethylene, but polypropylene recrystalizes faster than does polyethylene. Because of these and various other shortcomings of polypropylene, it has not been used in injection mold closure lids having a thin cross section, e.g., of 0.020 inch or less. Polyethylene is more flexible than polypropylene, making it easier to strip closure portions that overlie a portion of the mold steel during a stripping and ejecting of a molded closure from the mold.

Another general shortcoming of polypropylene plastic in its use to manufacture injection-molded lids is that unlike the polyethylene plastic, after molding, polypropylene does not continue to shrink in, resulting in what is called "toe-in" of the bottom of the skirt wall. That is, in polyethylene closures, the outer skirt contracts upon cooling of the injected plastic to form a lesser diameter at the bottom of the skirt to define a toe-in angle, which is the angle between the vertical and the taper of the lid skirt. Toe-in occurs in polyethylene lids and is used advantageously in the nesting and stacking of lids one-on-another. More specifically, one manner of stacking such closures made of polyethylene is to provide an upstanding stacking ring on the top of a closure and a "toe-in" centering engagement between the tapered upper skirt of the upper closure with a portion of the lower closure. Another form of stacking with a conventional polyethylene lid is the use of stacking ribs, which are ribs formed in the peripheral rim portion for engagement with another rim. However, the use of such stacking rings and stacking ribs adds considerably more plastic to these injection-molded, polyethylene closures.

These kinds of containers and closures are used with automatic filling and capping equipment to fill the containers and to place the closures on the filled plastic containers. Automatic closure handling equipment is also used to feed the closures for printing on the plastic closures after they have been molded. The closures are stored for use in such handling equipment in vertical stacks; and it is important that the space between adjacent skirts on adjacent closures be substantially uniform and centered because a pair of mechanical fingers are usually inserted into the space between lower feeding rings on the lower edges of the skirts to remove the lowermost closure from the stack. Therefore, it is important that the adjacent closures in the stack are not askew or tilted with respect to another, resulting in a larger air gap on one side between the skirts, and a smaller or no gap on the opposite side of the closures in the stack. Further, a partial vacuum should not be formed in an air space between adjacent, stacked closures that would cause the closures to stick together and impede the feeding of the closures. The failure of a closure to feed properly can cause production interruption or possibly equipment damage and is to be avoided. Thus, it will be seen that it is important that the closures, when stacked, are level and centered on the stack and have uniform spacing between adjacent feeding rings on the lower ends of the peripheral skirts of the closures.

Another form of closure that is commonly used particularly with dairy products and the like is a thermo-formed closure, which is made from a sheet of plastic such as polyethylene by a die forcing the plastic into the desired plug configuration. A large number of closures are formed simultaneously in the sheet and then the sheets are cut to form individual closures. The thermo-formed closures have their edges later rolled to form a closure rim having a dependent skirt in a secondary operation. Despite efforts trying to maintain close tolerances for thermo-formed closures, it is found that it is difficult to keep the thermo-formed closures precisely shaped and stacked for use in the automatic equipment. The thermo-formed closures are usually less expensive and contain less polyethylene plastic than injected-molded, polyethylene closures. For the same dairy application, the injected-molded, polyethylene lids have some wall portions of about of 0.024 inch thick as well as stacking ribs; while the thermo-formed lids often are only about 0.014 inch thick. Thus, there is a need for a new and improved injection-molded closure which has thinner walls, uses less plastic to compete with thermo-formed closures, which can be stacked and centered easily for use with automatic handling equipment and yet, which has sufficient rigidity to pass the strength drop test and rigidity to keep a central panel substantially flat and planar for printing or the like.

SUMMARY OF THE INVENTION

In accordance with the present invention, an injected, molded plastic closure, particularly for use with cold products, is provided with a thin wall, for example, with good centering and stacking capabilities. This is achieved by the use of a polypropylene injection-molded lid that has a flared, peripheral, depending skirt for stack alignment and centering and has a pair of spaced surfaces for stacking without the use of plastic ribs or an upstanding stacking ring, which use a lot of plastic.

In the illustrated and preferred embodiment of the invention, the thin wall, polypropylene closure has a thickness of less than 0.020 inch while a typical, injection-molded polyethylene closure will have walls with portions of at least 0.023 or 0.024 inch thick; and because of the use of stacking ribs and stacking rings, the polyethylene closure will use much more plastic than the closure of this invention.

In the preferred embodiment of the invention, the stacking of polypropylene closures is done without a toe-in angle for the skirt, as in polyethylene closures that have a toe-in of the skirt, and without a stacking ring that adds more plastic to the closure. This is achieved by the use of a pair of radially-spacing stacking supports and nested, engaged lower skirt portions for self-centering of the closures in the stack. The preferred centering is by flared upper and lower skirt portions being spaced by a small air gap, e.g., 0.002 inch, if perfectly centered, but engaging when not centered to center the closures with respect to one another. This is unlike the toe-in angle centering of polyethylene lids where there is no air gap.

Also, in the preferred embodiment of the invention, the upper closure is supported on the lower closure in a stack by a pair of stacking supports that are radially spaced from one another. The first inner stacking support is formed at the bottom of a substantially vertically-extending wall or panel joining the central panel to the top panel or peripheral rim portion of the closure. The outer stacking support comprises an underside of a bead or retention shoulder for retaining the closure on the container abutting a rim ledge or surface on the closure therebelow. Stack alignment and centering is obtained by a flared, lower skirt on the bottom of a peripheral skirt for engaging a similarly-contoured area on the upper skirt wall of an adjacent closure. Thus, the stacking and centering is obtained without the use of additional plastic being added to mold an upstanding stacking ring and without the toe-in from the polyethylene, or without the use of additional plastic being added to mold stacking ribs also heretofore used with polyethylene lids for stacking.

In accordance with an important aspect of the invention, the closures may be formed with vents to vent an air space between adjacent central panels of stacked closures to prevent the formation of a vacuum in this air space that would cause the closures to stick together. In one embodiment of the invention, the vents are achieved by providing a series of spaced lugs on the inner stacking support with the lugs being spaced from each other to allow air to flow through the spaces between adjacent lugs. In the embodiment of the invention having an annular retention ring for retaining an informational disk, the vents are formed by raised and lowered edges on the upper end of the retention ring to define spaced air vents to allow air to flow between a central panel of an upper closure and the supporting upper end of the annular retention ring of the closure therebelow. Thus, closures may, in accordance with the invention, be vented when stacked.

In accordance with another embodiment of the invention, the closure is provided with a flat, substantially horizontal, outer annular surface for engaging a foil or membrane seal secured across the top of the container at a matching, substantially horizontal, outer annular surface on the container. This closure will have the flared skirt and matching angled wall at the top of the skirt for centering and will have a second point of contact for stacking at or adjacent to the flat, foil engaging surface. Thus, the present invention provides a lightweight closure made of polypropylene that can be used with containers sealed with a foil or membrane.

In accordance with a still further embodiment of the invention, a lightweight, polypropylene closure is provided with a centering ring that projects upwardly and inwardly from the top of the closure to retain a disk of advertizing material, or the like, on the top central panel of the closure. This closure uses the top edge of the centering ring as the inner area of contact with another stacked closure along with the flared skirt and matching angled wall at the top of the skirt for centering and stacking of a stack of closures. Thus, there is provided a lightweight closure with a centering ring that uses the stacking and centering features of this invention.

DETAILED DESCRIPTION OF THE PREFERRED EMBODIMENT

In accordance with the preferred embodiment of the invention, an injection-molded closure 10 is made of polypropylene with a thin wall construction, for example, less than 0.020 inch in thickness, e.g., 0.018 inch in thickness, with a reduced amount of plastic being used and with good centering and stacking capabilities for use with automatic handling equipment. The lid is very low cost and has sufficient rigidity in a plane of central panel so that it can be used with packaging of various contents or applications including frozen applications.

Figure 1:
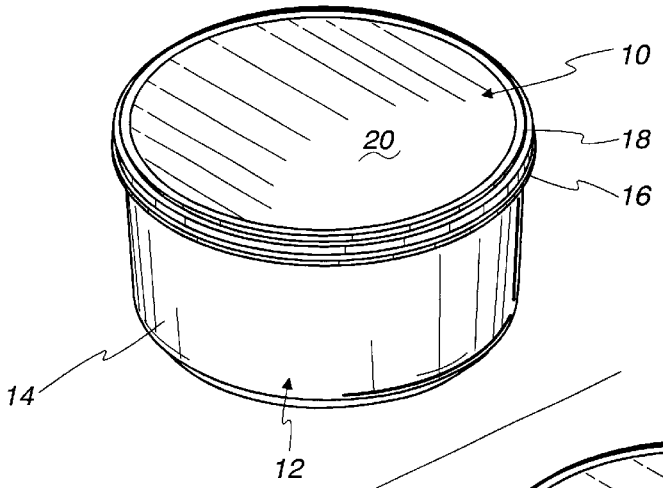
FIG. 1 is a perspective view of a container enclosure constructed in accordance with the preferred embodiment.
Figure 2:
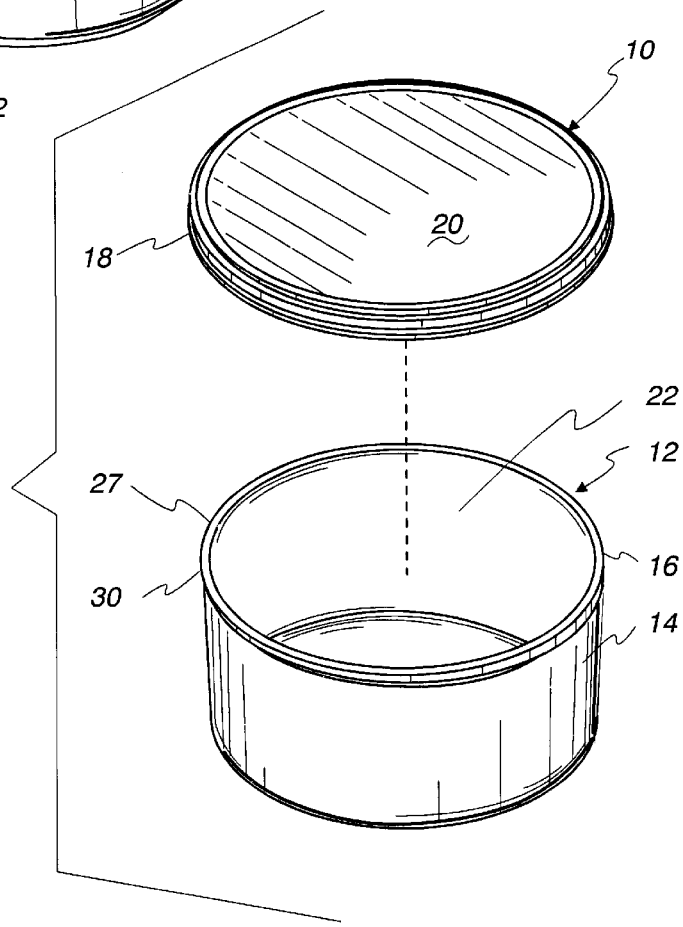
FIG. 2 is view similar to FIG. 1 with the lid spaced from the container.
Figure 3:
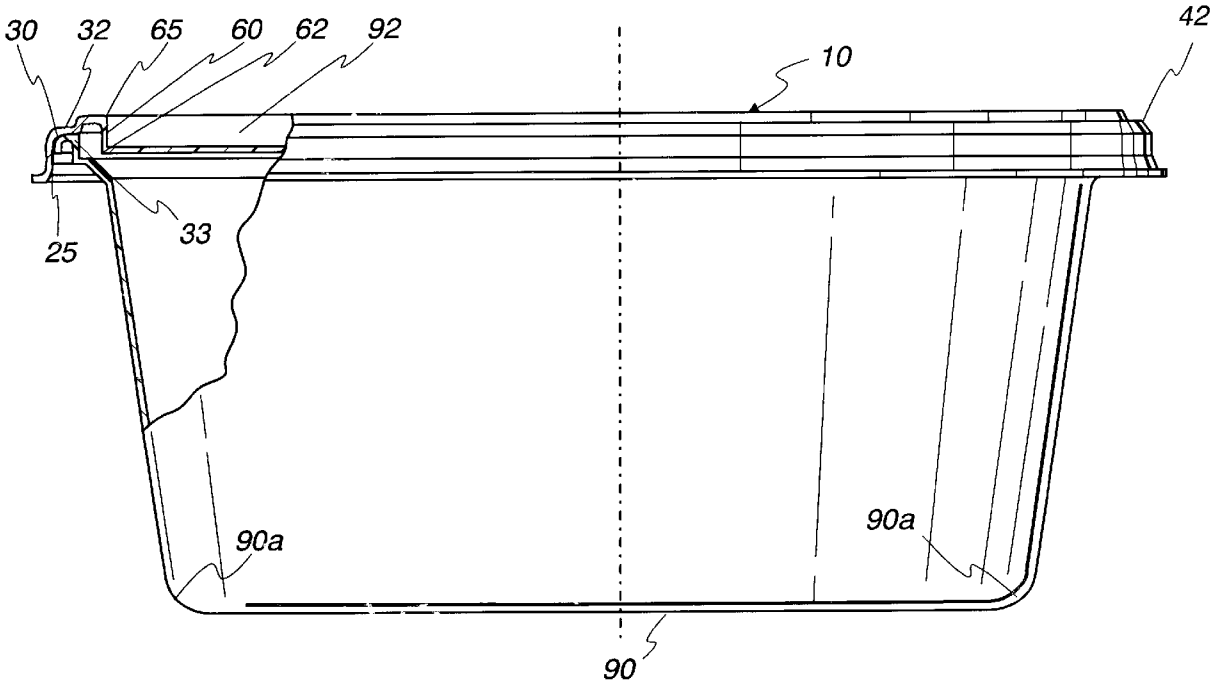
FIG. 3 is a view of the container and lid of FIG. 1 partially cross-sectioned.
Figure 4:
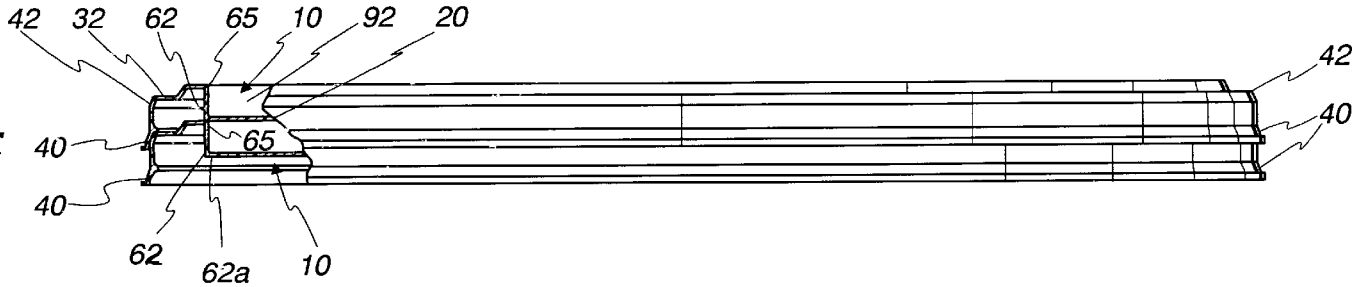
FIG. 4 is a view of a pair of closures stacked one-upon-another and embodying the novel features of the invention.
Figure 5:
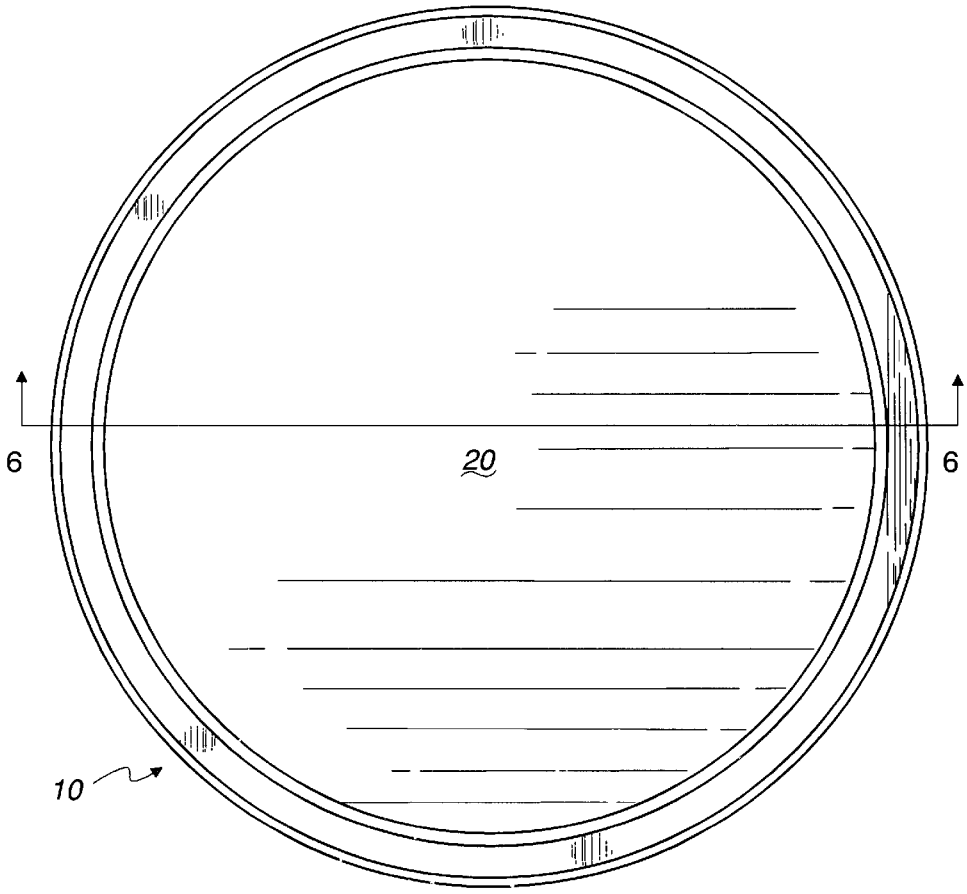
FIG. 5 is a plan view of the closure of the present invention.
Figure 6:
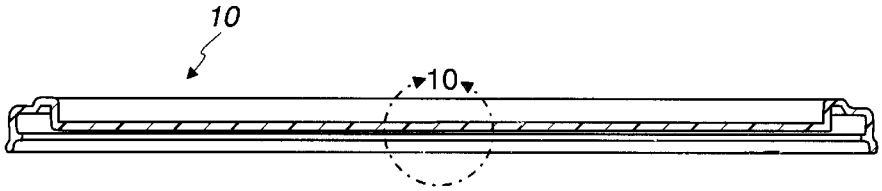
FIG. 6 is a cross-sectional view taken substantially along the line 6—6 of FIG. 5.
Figure 8:
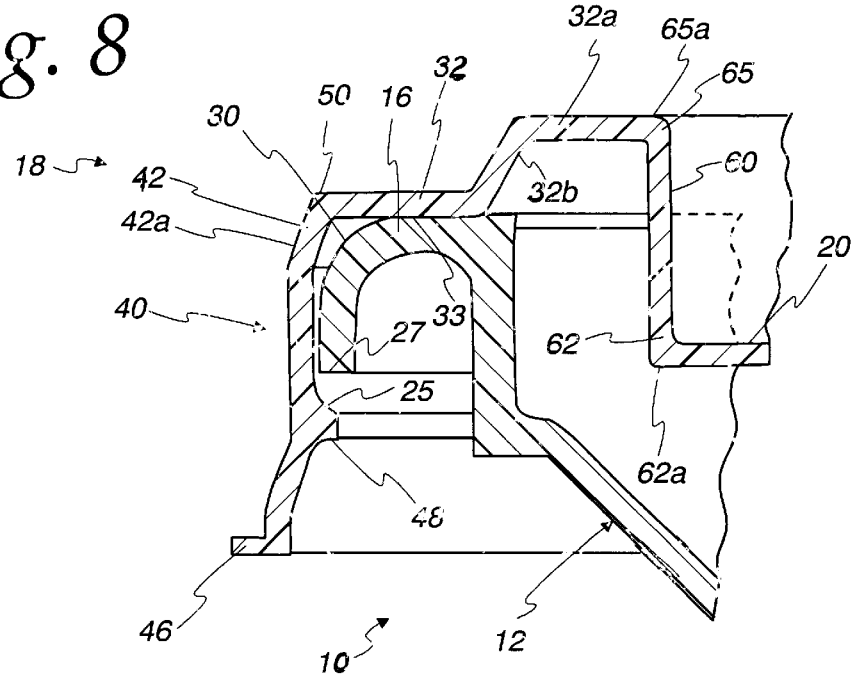
FIG. 8 is view of the closure of FIG. 7 mounted on a container rim shown in cross-section.

Referring now to the illustrated embodiment of the invention, as best seen in FIGS. 1 and 2, there is provided the closure 10 secured to an injection-molded container 12 also made of material of any kind, usually polyethylene or polypropylene plastic. The closure in this instance is generally circular, and the container has an encircling, circular sidewall 14 with an upper beaded, container rim 16 which is engaged by the encircling connecting peripheral closure rim 18. The closure rim is integrally connected to a central flat panel 20 in the closure 10. When the closure 10 is mounted on the container 12 to cover an open mouth 22 of the container, the rim 18 of the closure, as best seen in FIG. 8, has a projecting, inwardly-connecting or retaining bead or shoulder 25 which is positioned under an inturned rim end 27 of the container rim 16 to retain the closure on the container. This portion 25 of the closure that protrudes from the inside of the skirt wall to hold the closure on the container is often called the "undercut." When the closure is applied, the retaining shoulder 25 abuts the rounded, inclined, radius rim surface 30 on the container rim 27 and is cammed and deflected outwardly until it passes below the rim end 27 where the shoulder 25 is allowed to contract radially inwardly in the conventional manner. When the closure 10 is mounted on the container 12, a flat, annular top, rim ring 32 abuts a top surface 33 of the container rim; and thus, the container is supporting the closure by engagement of these annular rings supporting surfaces 32 and 33. The annular ring supporting surfaces 32 are often called the "top panel" of the closure rim.

The self-centering of the closures 10 within the stack is achieved by the use of a lower, nesting skirt, centering wall or portion 40 (FIG. 9) on the upper closure, which, if perfectly centered, is spaced by 0.002 inch from the adjacent nested wall of the adjacent closure. When being stacked, the upper nested wall of the upper closure will abut and center itself on a nesting wall or portion 42 on a depending peripheral skirt 43 of the annular rim of the lower closure. Herein, the nesting skirt 40 and nesting wall portions 42 are inwardly angled, or flared at an angle to the vertical, as illustrated in FIGS. 9–13. However, the nesting skirt could be formed with a short vertical and horizontal wall portions at substantially 90° to one another with the upper closure having an outer bottom nesting wall of a larger diameter than an upper portion of the skirt of the lower closure.

Figure 9:
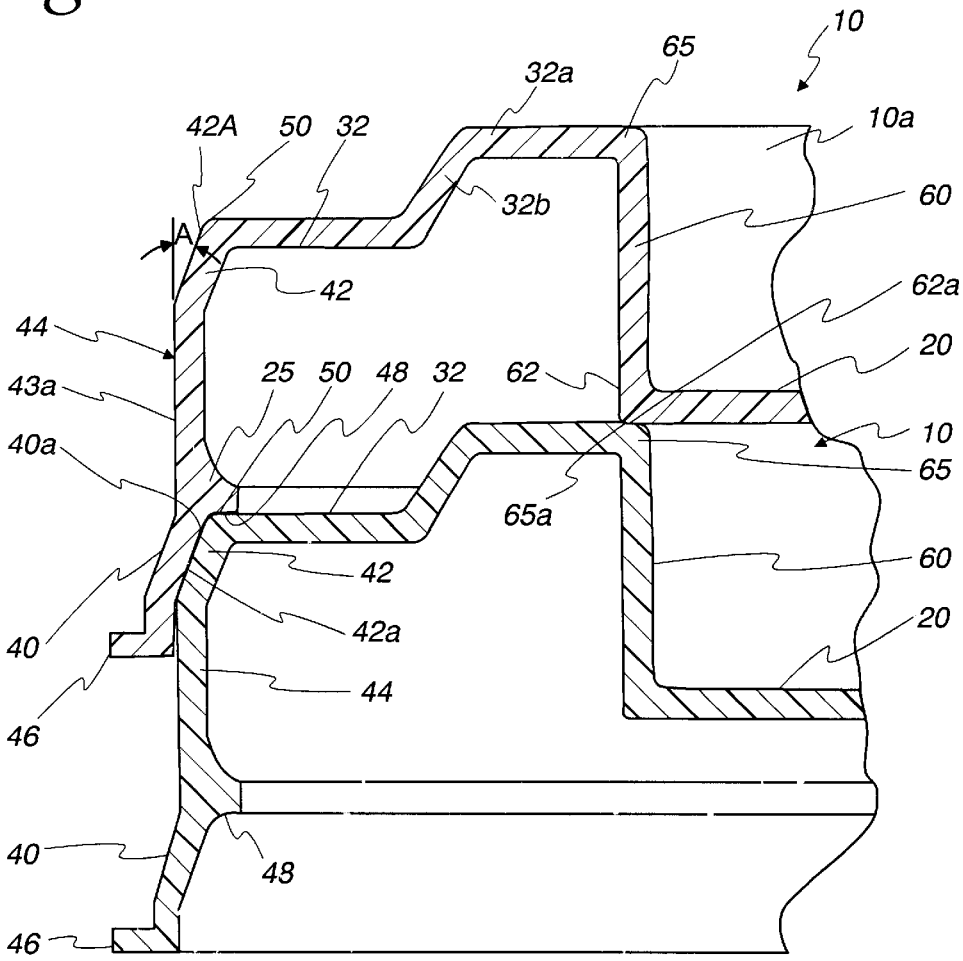
FIG. 9 is an enlarged view of the closure rim portions in cross-section stacked one upon the other.

In the illustrated and preferred embodiment of the invention the inner surface 40*a* of the flared skirt centering wall is dimensioned to be spaced from the facing outer surface 42*a* of the flared, inclined surface 42 on the depending peripheral skirt 43. For example, only a small space of several thousandths of an inch may be provided between the surfaces 40*a* and 42*a*. When the upper closure 10*a* is being lowered onto and nested upon the lower closure 10, as shown in FIG. 9, a feeding ring or flange 46 at the bottom of the closure skirt slides down the inclined, flared, wall surface 42*a*, thereby centering the upper closure on the lower closure. The downward sliding movement is arrested when the underside 48 of the retention shoulder 25 engages an outer corner portion 50 of the flat horizontal ring portion 32 at the top of the container rim 27.

When stacked and nested, the underside 48 of the undercut or retention bead 25 on the upper closure abuts corner 50 of the underlying ledge 32 of the lower closure to define a first, outer, stacking support and the second, inner, stacking support is constituted by stacking surfaces carried by vertical angular panel walls 60 abutting one another, as shown in FIGS. 9–13. More specifically, in the FIG. 9 embodiment, the upper angular panel wall 60 of the upper closure 10*a* has a lower corner 62 with an underlying bottom surface 62*a* which abuts an upper corner 65 on the underlying vertical rim wall 60 of the container 10. The surface 62*a* at the bottom corner abuts a top surface 65*a* at the top of the corner 65. There is an annular ring engagement between these bottom and top surfaces 62*a* and 65*a* to support the adjacent closures in the stack of closures. Thus, it will be seen that adjacent closures are supported by the inner and outer engaging surfaces or supports and are aligned and centered by the engagement of a flared skirt portion and the upper inclined wall of the peripheral skirt 40.

By way of example, the prepared and illustrated closure is made from a polypropylene material which is fairly resistant to being brittle at the temperatures involved and the preferred polypropylene is available from Montell Corporation. By way of example only, the wall thickness for the vertical angular panel wall 60 is 0.018 inch thick; and, in this instance, the central panel also has a thickness of 0.018 inch thick. The central panel 18 remains substantially flat and planar for printing thereon and for cosmetic reasons.

The top panel 32 of the closure rim is likewise about 0.018 inch in thickness as is the depending peripheral skirt 40. By way of example only, the inclined sidewall 42 of the flared skirt portion has an inclination at an angle A to the vertical of about 20° in this instance. Manifestly, such angle can be varied and still fall within the purview of the invention. Also by way of example only, the illustrated feed flange 46 has a thickness of about 0.018 inch in the vertical direction between its top and bottom surfaces and projects outwardly for about 0.20 inch from the bottom of the peripheral skirt 40. The top rim is defined by not only the radially outer horizontal ledge 32, but also is defined by the radially inner, horizontal top panel 32*a* and they are joined to one another by an inclined wall portion 32*b* which is, in this instance, at an angle of about 30° to the vertical.

In accordance with a further embodiment invention, a closure 10*b* is provided with an annular, substantially flat, and substantially horizontal annular ring or surface 70 (FIG. 11) of the central panel 20*b* which rests on the upper side of a foil or membrane seal 72 that is adhered to an underlying flat, horizontal surface 74 on a container 12*b*. In many instances, at the time of filling, the membrane or foil disk 72 is applied across the top of the container rim to cover and to seal the container contents from exposure to the atmosphere and ambient conditions, such as moisture in the ambient air.

When the closures 10*b* are stacked, the closures are centered by the lower flared skirt wall 40*b* on the upper closure and an upper flared depending skirt 43*b* on the lower closure; and the closures are stacked at the two points or areas of contact comprising the outer area of the undercut or retention shoulder 25*b* engaging corner 50*b* of the horizontal ledge 32*b* and the inner area of contact with the vertical, angular panel, walls 60*b* abutting one another. The closures 12*c* have feeding flanges 46*b*.

Figure 11:
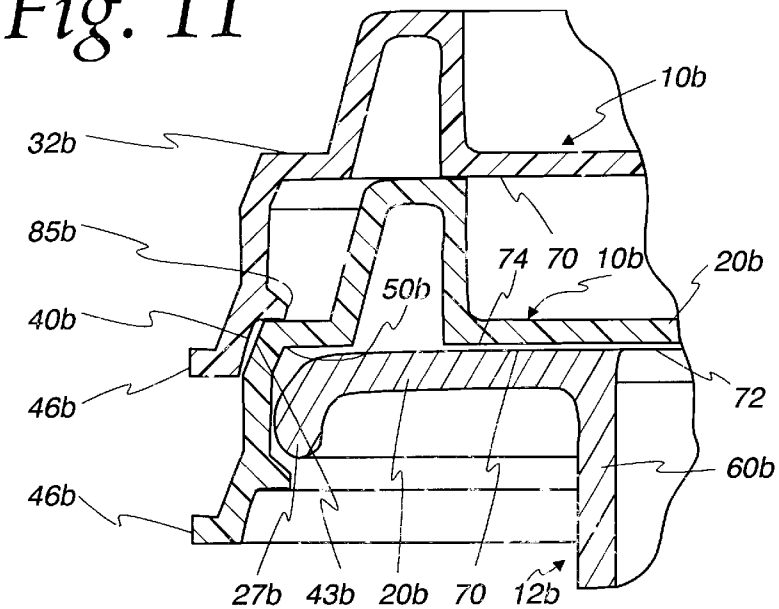
FIG. 11 is an enlarged, fragmentary view of another embodiment of the invention showing stacked rims of closures and a lower closure rim mounted on a sealing foil or membrane fixed to the container rim.
Figure 13:
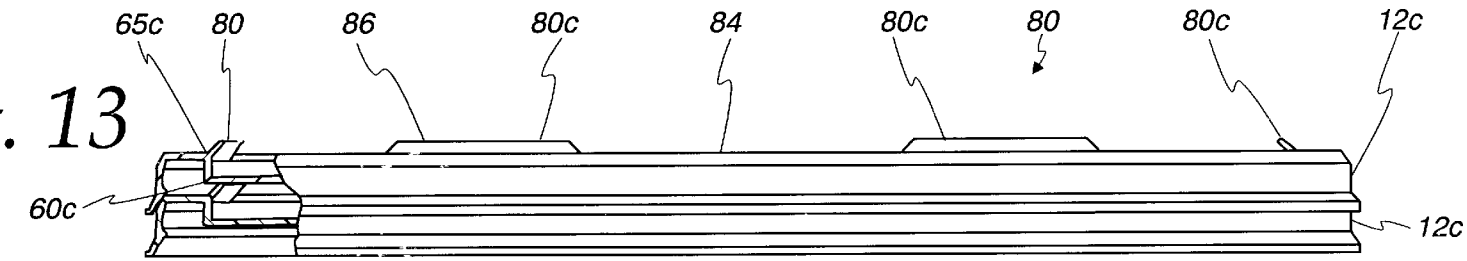
FIG. 13 is a side-elevational view of the retention ring closures of FIG. 12.

When contrasting the container 12*b* of FIG. 11 with the container 12 shown in FIG. 8, it will be seen that the container rim 16*b* of container 12*b* is much wider in distance in the radial direction between its outer rim end 27*b* and its inner vertical angular panel, wall 60*b* than the distance between the rim wall 27 (FIG. 8) of the container 12 and its inner, angular panel wall 60. This wider container rim 16*b* on container 12*b* provides the wider surface 74 on which the membrane outer edge sits and seals with the surface 74 on the closure 10*b*. In the embodiment of FIG. 8, the central plug, including the central flat panel 20, extend into the mouth of the container 12; whereas in the embodiment of FIG. 11, the central plug 20*b* of the closure 12*b* is above the horizontal foil 72 and above the mouth or lip of the container. The closure shown in FIG. 11 is often called a flat closure because it doesn't have a plug.

Figure 14:
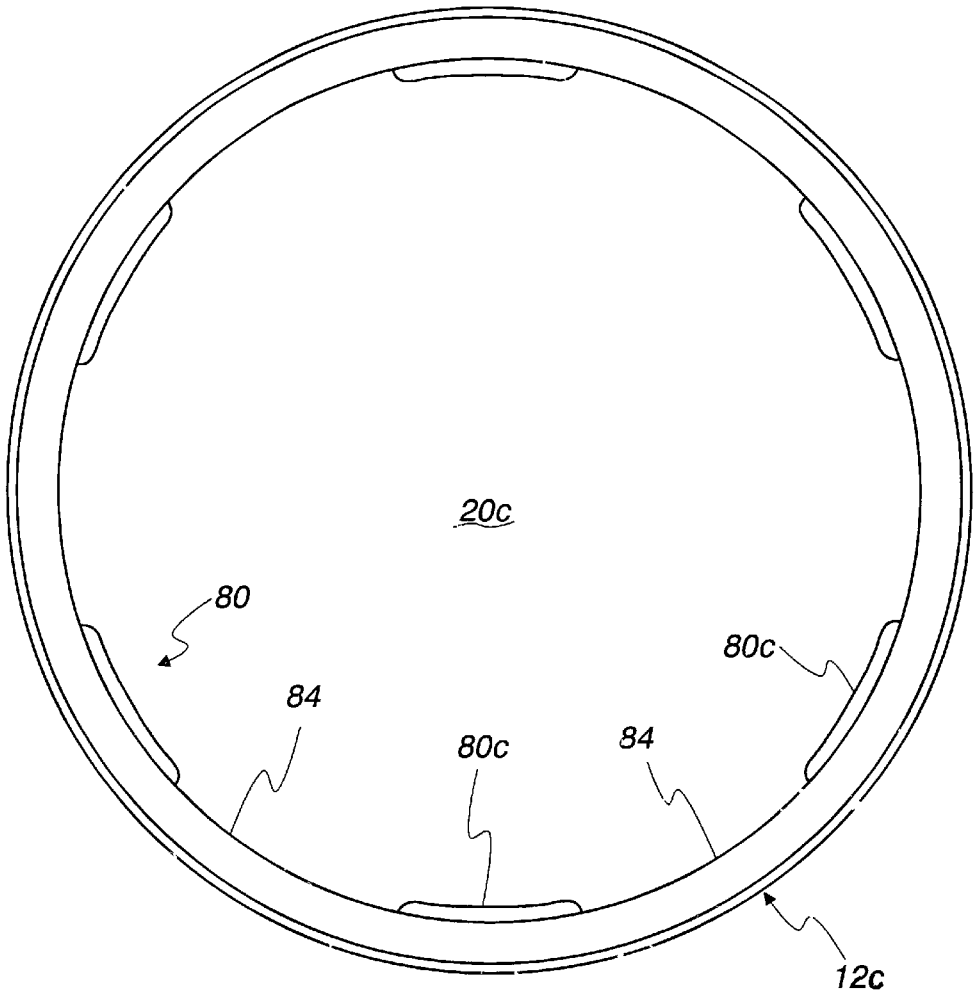
FIG. 14 is a plan view of the retention ring closure of FIG. 12.

In a still further embodiment of the invention, a closure 12*c* is provided with an interrupted retention ring 80 (FIGS. 12–14) which projects upwardly from the upper corner 65*c* of the vertical, angular panel wall 60*c* and which serves to retain an informational disk 82 on the top central panel 20*c* of the closure. The informational disk may be an advertisement sheet about the product in the container or other material, such as a coupon, or the like, etc. The preferred retention ring 80 comprises a series of spaced retention segments 80*c* projecting upwardly and radially inwardly over circumferential end 82*c* of the informational disk 82 on the central panel 20*c*. Herein, the retention ring is comprised of six retention ring segments that are spaced from one another by gaps 84 where there is no retention ring segment projecting upwardly from the vertical rim wall 60*c*. Manifestly, the number, size and shape of the retention ring wall segments may be varied from that illustrated and described herein. In this instance, the retention segment projects upwardly about 0.060 inch and is inclined at an angle of about 40° to the horizontal with a distance for an informational disk to be about 0.120 inch. Each retention segment projects radially inwardly from its vertical rim wall 60*c* by about 0.051 inch in this instance. The closures 12*c* have feeding rings 46*c*. The retention ring is preferably segmented to allow flexing of the segments when the segments are stripped from the mold steel. As stated above, polypropylene is less flexible than polyethylene. The retention ring may be a continuous ring ranter than a segmented ring, if so desired.

Figure 12:
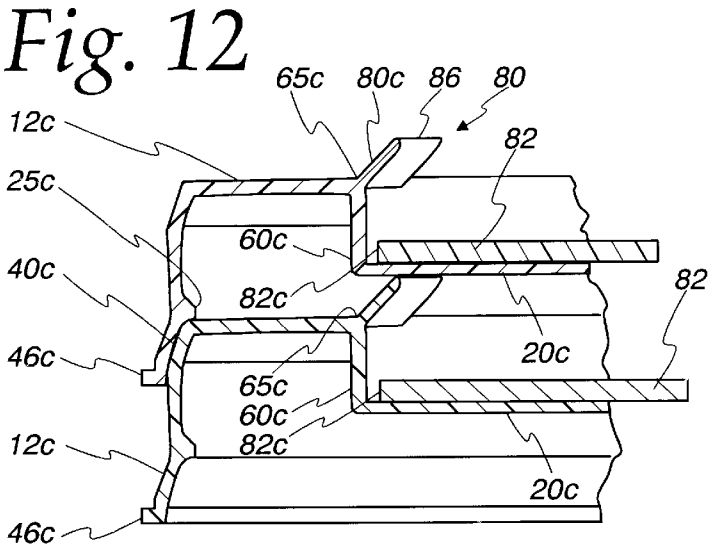
FIG. 12 is an enlarged, fragmentary view of a still-further embodiment of the invention showing stacked closures having rings for retaining inserts mounted on the top panel of closure.

When the closures 10*c* are stacked, as shown in FIG. 12, the centering is by use of lower flared skirt 40*c* of the upper closure engaging upper flared skirt 43*c* on the lower closure. Two points or areas of stacking support are provided by the undercut, retaining bead shoulder 25*c* on the upper closure 10*c* resting on ledge 32*c* of the lower closure 10*c* and the radially inward area of contact between top edge 86 of retention ring 80 on the lower closure with the central panel 20*c* of the upper closure 12*c*. The retention ring segments 80*c* constitute projections or continuations of the vertical angular panel walls 60*c*. The vertical angular panel walls 60*c* of the stacked upper and lower closures 10*c* are spaced, as shown in FIG. 12, whereas the vertical angular panel walls 60 of the stacked upper and lower closures are engaged, as shown in FIG. 9. The area of contact between the retention segments 80*c* and the central panel is closely adjacent the vertically-aligned walls 60*c* so that the stacking of closures is supported in substantially the same manner in both of these embodiments illustrated in FIGS. 9 and 12, respectively.

Both of the embodiments of FIGS. 11 and 12 are lightweight closures each preferably made of polypropylene and have a wall thickness of less than 0.020 inch, such as 0.018 inch wall thickness. For the illustrated lid shown in FIG. 11, having an outer diameter dimension of 4.183 inch, the weight of the lid is about 4.7 grams, by way of example only. The illustrated closure 12*c* of FIG. 12 is a larger closure having an outer diameter of 6.003 inch and its weight is only about 9.5 grams and its wall thickness is about 0.018 inch. The closures are formed of polypropylene which has a high melt index, e.g., of 35 on the polypropylene melt index. By way of example only, a preferred polypropylene having the good flow characteristics and high strength characteristics suitable for use with cold or frozen foods in small cross-sectional closures is sold by Montell Polyolefins, 800 Greenbank Road, Wilmington, Del. 19808, with only polypropylene being sold under the designation SG802N. Manifestly, other polypropylenes may be supplied by others than this particular supplier to be used in this invention. Thus, these embodiments of the invention provide lightweight closures which do not have stacking ribs, but which use flared skirts for centering and two spaced areas of contact for stacking.

Figure 20:
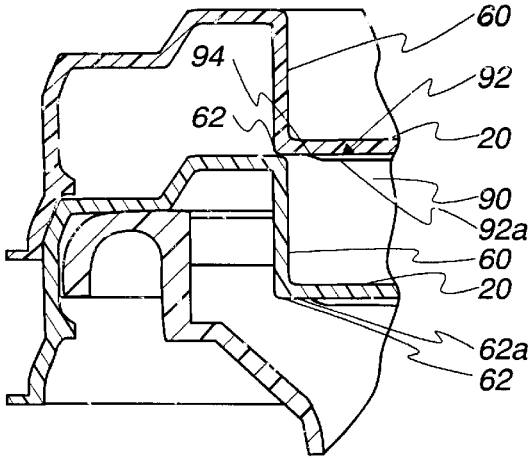
FIG. 20 is a partial cross-sectional view of two closures of FIG. 18 stacked together with a vent space therebetween.

In the embodiments of the invention disclosed in FIGS. 1–12, the closure 10 has a large central panel 20 that, when stacked, is spaced from another central panel to define an air space 90 (FIG. 20) therebetween. When the closures are stacked, some of the air between closures may be pushed out causing a slight negative air pressure or vacuum between the spaced closures at the space 90 (FIG. 20). This vacuum may cause the closures to stick together and not release the bottom closure as readily as desired with automatic capping machines when applying the closure to a container. To avoid this, it is preferred that closures described in FIGS. 1–12 be provided with vent areas or spaces to allow air to flow between the closures in the stack to prevent a vacuum in the space 90 that would cause the lids to stick together.

Figure 18:
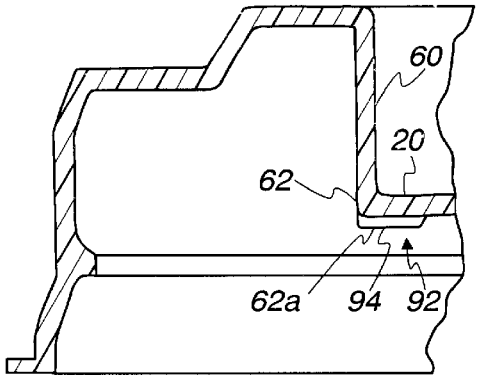
FIG. 18 is a partial cross-sectional view of the closure of FIG. 7 having a vent area and constructed in accordance with a further embodiment of the invention.
Figure 19:
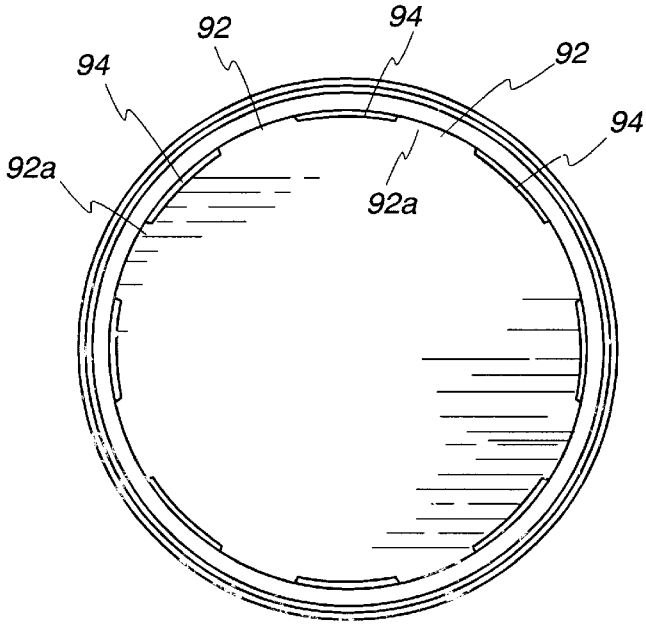
FIG. 19 is a bottom view of the closure of FIG. 18 and having a vent area therein.

In the embodiment of FIGS. 1–10 of closures without a retention ring, the closures are vented to allow air to flow into and from the space 90 between central panels 20 of adjacent stacked closures by vents 92 that are formed by adding lugs 94, which are spaced thickened areas at the bottom of the angular, vertical panel wall 60 of limited circumferential extent to provide vent spaces 92*a* between adjacent lugs 94. More specifically, the lugs 94 have a circumferential extent of about 22.5° with vent spaces 92*a* of about 22.5° therebetween, as illustrated in FIG. 19. As disclosed in FIG. 19, eight lugs 94 are provided and are equally spaced by eight vent spaces 92*a*. Manifestly, the size and number of venting lugs or venting spaces may be varied from that described for the illustrated embodiment of the invention of FIGS. 18–20.

The venting lugs 94 are preferably formed by adding a small increments of plastic, e.g., 0.005 inch along the bottom corner 62 of the angular panel wall so that the underlying surface 62*a* has eight lugs 94 of 45° in extent with each lug 94 projecting 0.005 inch beyond the adjacent vent areas on the underlying surface 62*a*. Thus, in this embodiment, there are eight vents 92 each of 0.005 inch in height and 45° in circumferential extent to allow air to flow between the central panels of adjacent stacked closures (FIG. 20) so that no vacuum is formed that would interfere with the release of the bottom closure of the stack.

Figure 15:
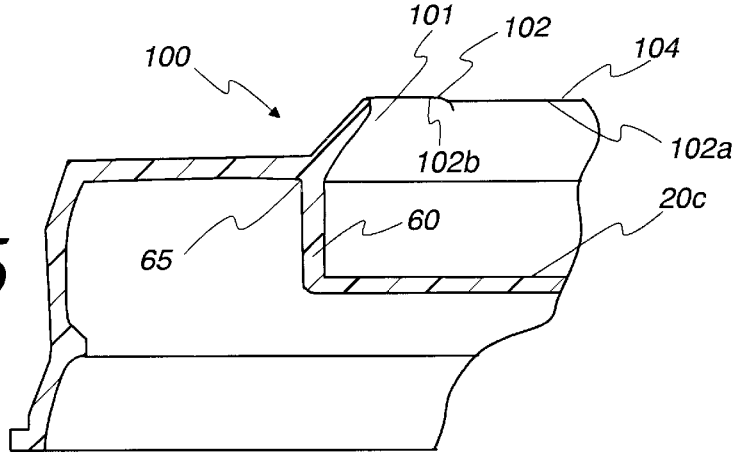
FIG. 15 is a partial cross-sectional view of a retention ring closure having a vent area and constructed in accordance with a further embodiment of the invention.
Figure 16:
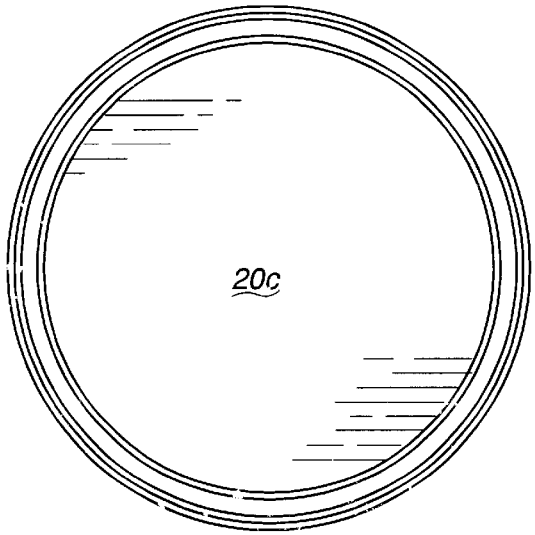
FIG. 16 is a bottom view of the closure of FIG. 15 and having a vent area therein.
Figure 17:
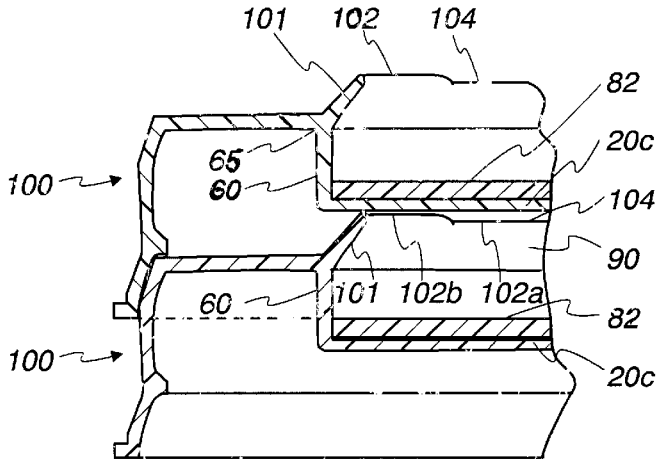
FIG. 17 is a partial cross-sectional view of two closures of FIG. 15 stacked with a vent space therebetween.

In another embodiment of the invention, which is disclosed in FIGS. 15–17, a retention ring closure 100 is formed with a retention ring 101, which projects at an inclined angle upwardly from the upper corner 65 of the angular panel wall 60 and serves to retain an informational disk 82 on the top of the central panel 20 of closure. Rather than having a retention ring 80 formed of a series spaced retention segments 80*c*, as in the embodiment of FIGS. 12–14, the retention ring 101 is a continuous annular ring without being segmented and which has an upper edge or surface 102 that has vents 104 therein to allow air to flow into the space 90 between adjacent central panels 20*c* of adjacent closures 100. Herein the vents 104 are formed by having lowered edge portions 102*a* between raised edge portions 102*b* in the upper edge 102 of the retention ring 80. That is, the lower edge portions 102*a* are located about 0.010 below the adjacent raised edge portions to form the vents 104 through which air flows into the space 90 between adjacent, central panels 20*c* of stacked closures. Herein, six vents of 20° circumferential extent are provided and are spaced by six raised edge portions 102*b* of 40° circumferential extent. Manifestly, the size and number of vents may be changed from that described above for the illustrated embodiment of the invention.

When nested, as seen in FIG. 17, the closures 100 have the space 90 between their respective central panels 20*c* and further defined by an annular panel wall 60 and retention ring 101 when the upper edge portions 102*a* of the bottom closure support the central panel 20C of the closure thereabove. This space 90 would be sealed if the top edge of the retention ring 101 was continuously engaging the central panel throughout 360° and a vacuum could be formed in the space 90. But, the vents 104 formed by the lowered edge portions 102*a* in the top edge of the retention ring 101 allow air to flow to and from the space 90 to prevent the formation of a vacuum between the stacked closures 100. Thus, the lowermost closure will be unimpeded in its release from the stack.

The closures of FIGS. 15–20 are identical, except for the vents, with the closures described in FIGS. 1–14 and they stack in the same manner and are made of the same injection molded plastic materials as used for the closures of FIGS. 1–14 and described herein. Hence, a description of the stacking and materials used need not be repeated for the FIGS. 15–20 embodiment of the invention.

Figure 7:
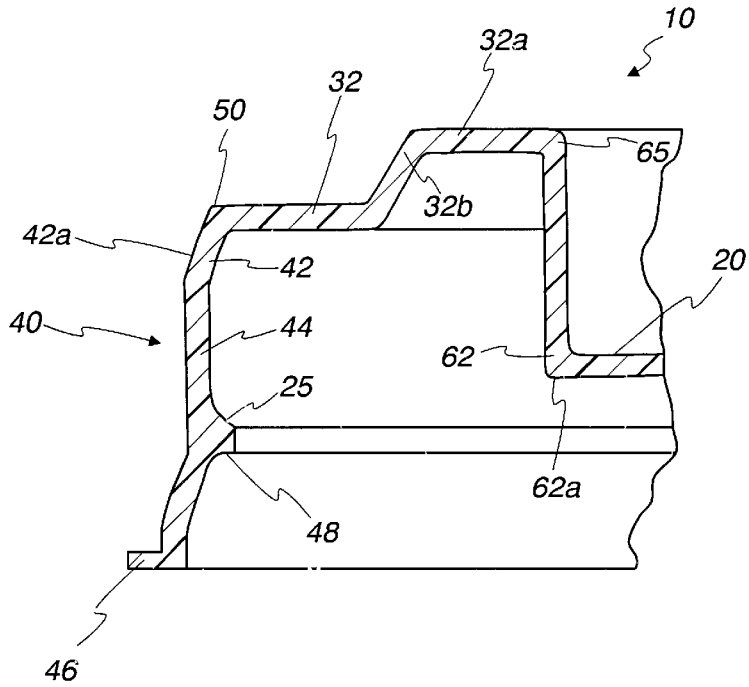
FIG. 7 is an enlarged fragmentary view of the peripheral rim portion of the closure of FIGS. 5 and 6.
Figure 10:
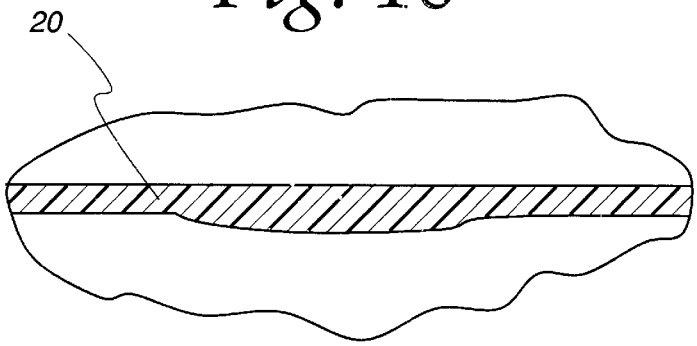
FIG. 10 is an enlarged cross-sectional view taken along the line 10 of FIG. 6.

It will be appreciated that in injection-molded closures and containers, that the corners are thicker than the walls meeting at the corner. Also, other sections of the closure may be thicker than the thin wall thickness, which is 0.018 inch in this instance. For example, as shown in FIGS. 7–9, the feeding ring 46 at the bottom of the shirt 43 provides a thicker cross-section than the remainder of the wall of the skirt 43 thereabove; the retention bead 25 on the nesting skirt wall portion 40 provides a thicker cross-sectional area in the skirt wall portion 40; and a thickened center portion is provided at the center of the top central panel 20, as shown in FIG. 10. Thus, the closure has walls of varying cross-sectional thicknesses therein. But because the large area walls are thin, the closure is made with a reduced amount of plastic, and hence, is lower is cost. Likewise, the container sidewall and bottom wall are, in this instance, thin and about 0.018 inch thick. Thus, the closure and container are preferably both made of polypropylene and thin walled to provide a low cost, combination of a closure and container.

It will be appreciated that the containers 12, when filled with contents, are often stacked one upon another with a bottom wall 90 (FIG. 3) having a size and dimension with rounded corners 90*a* around encircling the bottom of the container to fit within the plug shaped opening or impression 92 in the closure below. That is, in a stack of filled containers, the bottom wall of a filled container will rest on the upper side of the closure panel 20 on the filled container therebeneath.

From the foregoing, it will be seen that the combined inner and outer stacking surfaces, as well as the flared skirt, does the centering and alignment of the closures within the stack provides for keeping the feeding ring 46 of the respective closures in the stack spaced at a uniform gap spacing 47 from one another so that the mechanical fingers which move into the gap 37 may easily remove closures without interference and loss of production.

In the embodiments of the invention illustrated in the drawings a feed flange 46, 46B and 46C has been provided in the lower end of the container rim 27 for use with certain automatic container handling equipment. On the other hand, with other automatic container handling equipment, it is desirable to provide the closure without the feed flange 46, 46B or 46C; and the closure is molded without a feed flange for use with such equipment. Thus, the closure of the present invention can be made with or without a feed flange thereon.

Now that the specific embodiments of the invention have been described and shown, it is apparent that various alterations and modifications can be made therein without department from the inventive concept of the invention. Therefore, the intention in the attended claims to cover all such modifications and alterations as may fall within the scope and the spirit of the invention.

What is claimed is:

1. An injection-molded, plastic closure for closing a mouth of a container and adapted to be nested in a stack of closures; the closure comprising:

a substantially flat, central panel for covering the open mouth of the container;

an encircling rim joined to the central panel to receive a container rim;

an inner, angular panel wall on the closure rim, the inner, angular panel wall being connected to the central panel and defining a corner at their juncture;

a first, inner stacking support located on the inner, angular panel wall for stacking the closure in a stack of closures;

an outer depending, peripheral skirt on the encircling rim having a retention shoulder for positioning beneath the container rim to secure the closure to the container;

the peripheral skirt having a wall of a first predetermined cross-sectional thickness with the retention shoulder thereon adding additional cross-sectional thickness thereto thereby providing a peripheral skirt wall with a varying cross-sectional thickness;

a first stacking surface on a portion of the rim;

a second stacking surface on the lower portion of the retention shoulder for engaging the first stacking surface of an adjacent closure in a stack to provide a second, outer stacking support;

the closure adapted to be supported on a lower closure by the first inner stacking support and by the outer stacking support;

a nested lower skirt portion on the peripheral skirt for self-centering of the closure with an adjacent closure in a stack;

a retention ring is formed on the closure to retain an insert on the central panel of the closure; and a portion of the retention ring being the first stacking portion for engaging another closure in the stack.

2. A closure in accordance with claim 1, wherein the retention ring comprises a plurality of spaced segments projecting upwardly from the inner, vertically-extending wall on the closure rim.

3. A closure in accordance with claim 2, wherein the retention ring segments are adapted to abut the central panel of a closure thereabove in a stack of closures and thereby define the first, inner stacking support.

4. A closure in accordance with claim 3, wherein the retention ring segments project upwardly and radially inwardly from the inner, angular panel wall of the closure rim.

5. An injection-molded, plastic closure for closing a mouth of a container and adapted to be nested in a stack of closures; the closure comprising:

a substantially flat, central panel for covering the open mouth of the container;

an encircling rim joined to the central panel to receive a container rim;

an inner, angular panel wall on the closure rim, the inner, angular panel wall being connected to the central panel and defining a corner at their juncture;

a first, inner stacking support located on the inner, angular panel wall for stacking the closure in a stack of closures;

an outer depending, peripheral skirt on the encircling rim having a retention shoulder for positioning beneath the container rim to secure the closure to the container;

the peripheral skirt having a wall of a first predetermined cross-sectional thickness with the retention shoulder thereon adding additional cross-sectional thickness thereto thereby providing a peripheral skirt wall with a varying cross-sectional thickness;

a first stacking surface on a portion of the rim;

a second stacking surface on the lower portion of the retention shoulder for engaging the first stacking surface of an adjacent closure in a stack to provide a second, outer stacking support;

the closure adapted to be supported on a lower closure by the first inner stacking support and by the outer stacking support;

a nested lower skirt portion on the peripheral skirt for self-centering of the closure with an adjacent closure in a stack;

vents formed in the closure to allow air to flow into and from the air space between adjacent central panels of the closures when stacked;

an annular retention ring formed on the closure to retain an insert on the central panel of the closure; and raised and lowered edges on a top edge of the retention ring to define the vents for venting the air space between adjacent central panels of the closure when stacked, the raised edges projecting upwardly for engaging another closure thereabove in the stack thereby comprising the first stacking portion for the closure.

6. An injection-molded, plastic closure for closing a mouth of a container and adapted to be nested in a stack of closures; the closure comprising:

the closure being injected molded of polypropylene plastic of 0.020 or less in cross-sectional thickness;

a substantially flat, central panel for covering the open mouth of the container;

an encircling rim joined to the central panel to receive a container rim;

an inner, angular panel wall on the closure rim, the inner, angular panel wall being connected to the central panel and defining a corner at their juncture;

a first, inner stacking support located on the encircling rim for stacking the closure in a stack of closures;

an outer depending, peripheral skirt on the encircling rim having a retention shoulder for positioning beneath the container rim to secure the closure to the container;

the peripheral skirt having a wall of a first predetermined cross-sectional thickness with the retention shoulder thereon adding additional cross-sectional thickness thereto thereby providing a peripheral skirt wall with a varying cross-sectional thickness;

a first stacking surface on a portion of the rim;

a second stacking surface on the lower portion of the retention shoulder for engaging the first stacking surface of an adjacent closure in a stack to provide a second, outer stacking support;

the closure adapted to be supported on a lower closure by the first inner stacking support and by the outer stacking support;

a nested lower skirt portion on the peripheral skirt for self-centering of the closure with an adjacent closure in a stack;

the retention shoulder having a flat, substantially horizontal lower surface; and a series of spaced lugs formed on one of said first and second stacking surfaces adding areas of increased cross-sectional thickness to the stacking surfaces, the spaced lugs being separated by spaces forming vents to allow air to flow to vent the lid from an adjacent stacked lid.

7. An injection molded, plastic closure in accordance with claim 6 wherein the series of spaced lugs are formed on the first stacking surface.

* * * * *